US005515649A

United States Patent [19]

Strab

[11] Patent Number: 5,515,649

[45] Date of Patent: May 14, 1996

[54] AUTOMATIC DOOR OPERATOR

[75] Inventor: Thomas J. Strab, Yorklyn, Del.

[73] Assignee: Gentleman Door Company, Yorklyn, Del.

[21] Appl. No.: 291,049

[22] Filed: Aug. 15, 1994

[51] Int. Cl.[6] ..... E05F 15/00

[52] U.S. Cl. ..... 49/280; 49/276; 49/300; 49/340

[58] Field of Search ..... 49/280, 300, 279, 49/340, 276

[56] References Cited

U.S. PATENT DOCUMENTS

| | | | |
|---|---|---|---|
| 887,530 | 5/1908 | Scott et al. | 49/280 |
| 1,169,649 | 1/1916 | Kafader et al. . | |
| 2,466,855 | 8/1947 | Lauver . | |
| 2,733,918 | 2/1956 | Fisher | 49/280 |
| 2,835,488 | 5/1958 | Hubbell | 49/280 X |
| 2,893,726 | 7/1959 | Sharpe | 49/276 |
| 3,099,438 | 7/1963 | Fritz | 49/280 X |
| 3,521,921 | 7/1970 | Miyazaki . | |
| 3,614,147 | 10/1971 | Spector | 292/254 |
| 3,829,138 | 8/1974 | Morita | 292/254 |
| 3,874,117 | 4/1975 | Boehm | 49/340 X |
| 4,183,177 | 1/1980 | Kurdziel | 49/276 X |
| 4,660,324 | 4/1987 | Nyenbrink | 49/340 |
| 4,771,218 | 9/1988 | McGee | 318/16 |
| 4,902,052 | 2/1990 | Laine | 292/144 |
| 5,050,346 | 9/1991 | Eccleston | 49/280 |
| 5,095,654 | 3/1992 | Eccleston | 49/280 |
| 5,269,098 | 12/1993 | Reoman | 49/360 |
| 5,375,374 | 12/1994 | Rohraff | 49/340 |

FOREIGN PATENT DOCUMENTS

| | | | |
|---|---|---|---|
| 1462376 | 11/1966 | France | 49/276 |

OTHER PUBLICATIONS

Power Access Corporation, Product Sheet, Automatic Door Opener.

Dor–O–Matic® JR–Swing Handicap Door Operator Product Sheet.

Stanley Magic–Door, Product Sheet Automatic Door Operator.

C&C Dynamics Residential Door Swing Operator Product Advertisement.

*Primary Examiner*—Philip C. Kannan

[57] ABSTRACT

A door operating system is disclosed which includes a remotely or manually controlled fluid supply system (10) which pressurizes a reciprocable striker release assembly (50), and activates an opening cylinder assembly (30) functionally mounted to a door (17) and door frame (18) for opening the door. Components of the door operating system include: an air compressor (11); a fluid pressure regulator (15) for ensuring, by virtue of a higher pressure, that the striker release assembly (50) is actuated in a timely manner with respect to the opening of the door due to activation of an opening cylinder (32) and for controlling the power and the speed that the door opens; a three-way solenoid valve (12), manually or remotely actuated, for releasing pressurized fluid to the opening cylinder (32) during the opening cycle and discharging fluid during the closing cycle thereby permitting closing of the door; a pair of clevis brackets (31,33), and a door frame bracket (35) for ease in installation of the opening cylinder (32); and a door closer (34) mounted on a side of the door opposite to the opening cylinder location.

19 Claims, 2 Drawing Sheets

AUTOMATIC DOOR OPERATOR

This invention relates to a door operating system, which system utilizes a regulated fluid means to operate power cylinders for the purpose of unlatching and opening a door gently.

BACKGROUND OF THE INVENTION

Prior door operating systems use an apparatus which attaches to the door and door knob. Examples of this type of door operating system are found in U.S. Pat. Nos. 5,050,346 and 5,095,654. Generally, these known operating systems use an air compressor, actuated by a transmitter/receiver, for charging fluid lines in the door operating system. The known device includes a first sub-assembly comprising an air cylinder, mounted on the door frame and door, which provides an opening force. A second sub-assembly also comprising an air cylinder provides force to a rack-and-pinion type mechanism for turning the door's dead-bolt and door knob. The second sub-assembly further includes a strap which is mounted to a push rod at one end of the air cylinder with another end of the strap wrapped around the door knob for rotation of the same. The rack-and-pinion portion of the second sub-assembly requires a clam shell type structure fastened to the dead bolt by a clamp having teeth for meshing with the rack. The air cylinder of the second sub-assembly includes springs for retraction of the push rod and rack. After de-activation of the air compressor by remote control, the door is closed by a force which is provided by a torsion spring mounted in the first sub-assembly.

An advantage of the known door operating system is that it provides a way of opening a door from a remote location. A further advantage of the system is that it can be retro-fitted to an existing door. Some disadvantages of the known door operating system include the number of specialized parts required (which increases cost), and the cost of the labor used to assemble the parts. Moreover, as moving parts are exposed, there is a risk of injury regarding the operation of the second sub-assembly, e.g. where a child or animal could get a body part pinched or entangled in the sub-assembly as it is being activated or deactivated. Further, because it is exposed to casual observation in a home or office living environment it may not present an aesthetically pleasing door hanging, for example, because of the industrial-looking nature of the parts. Furthermore, the known device interferes with the normal operation of the door knob and dead bolt; moreover, the known device includes a compressor which must continuously run to hold the door open which is a disadvantage because it contributes to the noise and energy inefficiency of the system.

Other known door operating systems use an electromagnetic motor to drive an opening mechanism; however, these systems generate noise when in operation, do not provide for unlatching of a door latch, and are costly to purchase and install.

It is therefore desired from the standpoint of cost, ease of assembly and operation, safety, and number of parts, a door operating system which opens gently, is easy to install and to relocate, of low cost and is easy to maintain, but is compact, reliable, and is basically safe in operation.

SUMMARY OF THE INVENTION

It is an object of the present invention to provide a low cost door operating system.

It is a further object of this invention to provide a door opening system which gently opens a door, and is otherwise safe to use.

It is yet another object of the present invention to provide a door opening system which is easy to install, assemble, and maintain.

It is yet a further object of the invention to provide a door operating system which can be retro-fitted to existing doors, or installed for doors in the new construction of dwellings.

It is a another object of the present invention to provide a door operating system which is adaptable to heavy or steel doors using a magnetic sealing strip (i.e. weather stripping).

It is yet another object of the present invention to provide a door opening system which will utilize the existing latches and hinges commonly found on most household doors.

It is still a further object of the present invention to provide a door operating system which is capable of holding the door open for extended periods of time yet is energy efficient.

Accordingly, the present invention achieves the above objects by providing a door operating system comprising a remotely or manually controlled fluid supply means which pressurizes a reciprocable striker release, and activates an opening cylinder functionally mounted to a door and door frame for opening the door.

Components of the present invention generally include: a source of fluid pressure, e.g. an air compressor; a fluid pressure regulator for ensuring that the striker release is actuated in a timely manner with respect to the opening of the door due to activation of the opening cylinder; a three-way solenoid valve, manually or remotely actuated, for releasing pressurized fluid to the opening cylinder during the opening cycle and discharging fluid during the closing cycle thereby permitting a closing of the door; an optional pusher assist cylinder for use with steel doors having an interface for magnetic weather-stripping; a pair of clevis brackets and a door frame bracket for ease in installation of the opening cylinder; and a door closure mounted on a side of the door opposite to the opening cylinder location.

DETAILED DESCRIPTION OF THE INVENTION

Figure 1:
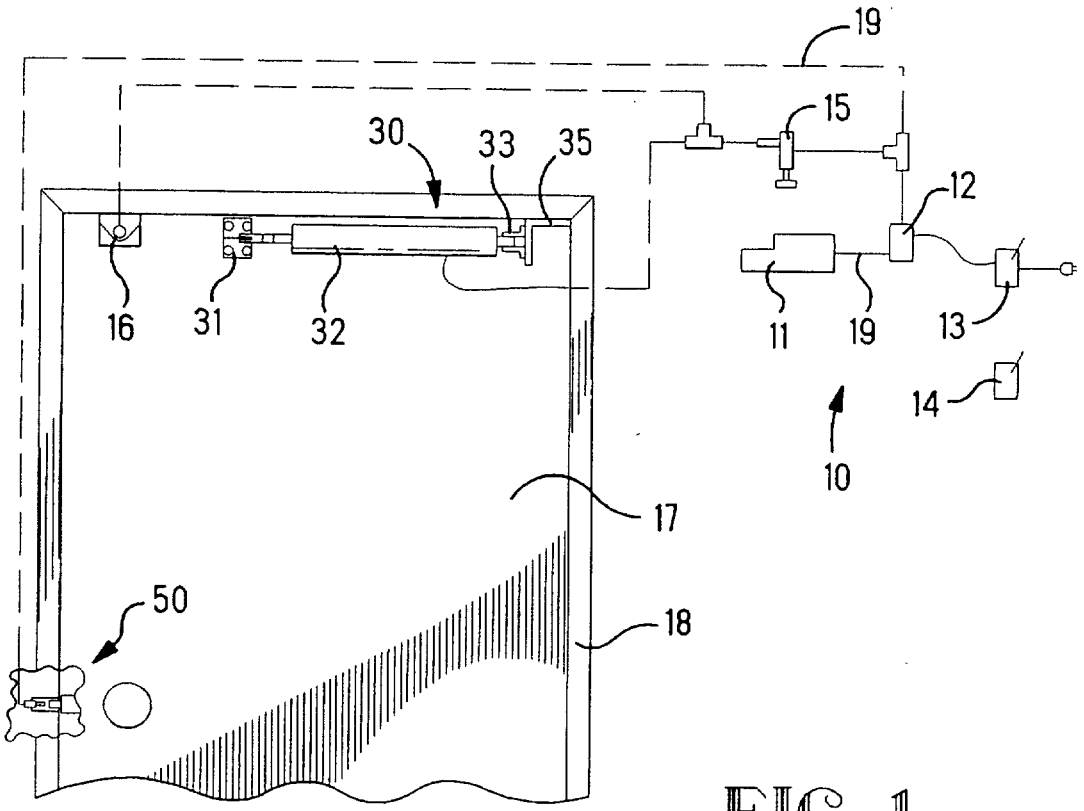
FIG. 1 is a schematic view of the present invention showing the door operating system.
Figure 2A:
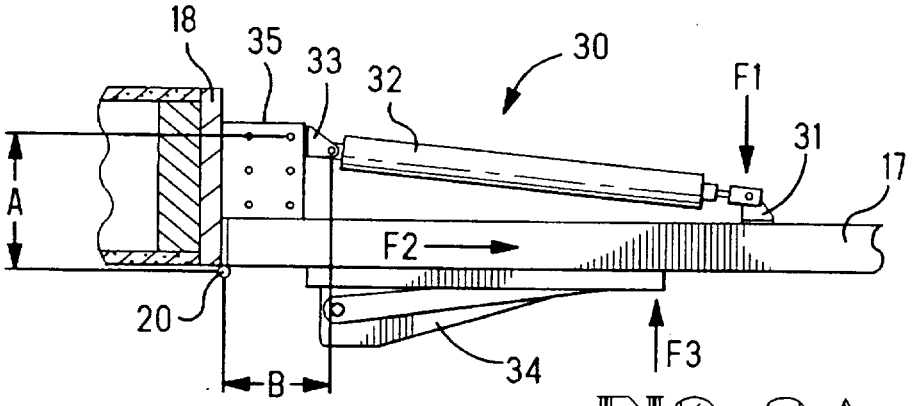
FIG. 2A shows the power cylinder of the present invention in the closed position, mounted to the door and door frame bracket.

Referring to the above-described Figures, the present invention basically requires a fluid pressure supply system 10, a valve 12, pressure regulator 15, door opener assembly 30, and a striker release assembly 50. Shown in FIG. 1 is a door 17 mounted to frame 18 by hinges 20 (FIG. 2A). Also shown in the drawing, in a schematic fashion, is fluid pressure supply system 10, comprising a compressor 11, which includes a pressure receiving tank. Compressor 11, a commercially available part, is powered by a 120 volt AC circuit and should be located in an out-of-the-way area, for example, a closet, garage, or basement. The compressor includes a built-in pressure regulator which controls the system pressure limits to between 50–100 PSI. Standard tubing 19 supplies air to electrically controlled 3-way valve 12 (solenoid valve), for example, those sold by SMC Pneumatic's NVF 110 series. The 3-way valve 12 is electrically controlled by a receiver 13 and transmitter 14, for example, those which are available in Radio Shack's X-10 series for on/off switching. Pressure regulator 15 is adjusted to activate the striker release assembly 50 before the door opener assembly 30, for reasons described below. A pusher assist 16 (air cylinder) may be installed for steel doors to provide additional opening force where needed as for steel doors used with magnetic weather-stripping or heavy doors.

Referring now to FIG. 2A, the door opener assembly includes a commercially available power cylinder 32 pivotably mounted to a first clevis bracket 33, which is in turn rigidly mounted to frame 18 by door frame bracket 35. The other end of cylinder 32 is pivotably mounted to a second clevis bracket 31. In a preferred embodiment, the cylinder has a 10-inch stroke, and such cylinders are sold by, for example, the Schrader Bellows Corporation. The opening speed of the cylinder 32 is controlled by an adjustable speed control/muffler mounted in a venting port of the cylinder 32, and the speed control/muffler should be screw adjusted to open the door 17 in about 4 to 5 seconds. The force exerted in opening the door is controlled by the pressure regulator 15 as further described below. The closing speed of the door is controlled by an adjustment means on a door closer 34. The door closer 34, for example, as supplied by the Sentinal Group, provides the closing force required to shut the door gently.

Figure 2B:
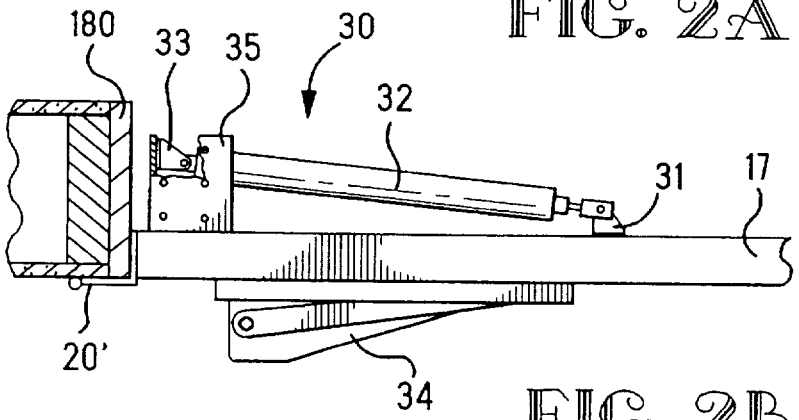
FIG. 2B shows an alternative embodiment of the instant invention for use with an offset door hinge.
Figure 3A:
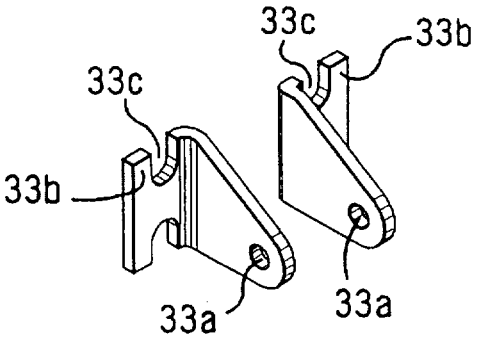
FIG. 3A shows an isometric view of the power cylinder bracket for mounting the power cylinder to the door frame.

Referring now to FIG. 3A, the clevis bracket 33 is shown. Brackets 31,33, which are made up of two substantially the same clevis brackets (only one is shown in the drawing), include a through-hole 33*a* for receipt of a clevis pin which pivotably mounts the ends of the cylinder 32, and further include a flange 33*b* with mounting cut-outs 33*c* for mounting screws or bolts. Bracket 33 is mounted to door frame bracket 35 as shown in FIG. 1, and door frame bracket 35 is mounted to door frame 18 by, for example, wood screws (e.g. size 1¼") extending through holes 35*b* (see also FIG. 3B). In the preferred embodiment, distance A shown in FIG. 2A is about 4⅜" and distance B is about 4⅝", as is further described hereinbelow. Brackets 31,33,35 can be mounted on a left or right hand side orientation relative to door 17, and can be rotated 180 degrees for use with an offset-type hinge 20' which would keep distances A and B remain the same (see FIG. 2B). Referring again to FIG. 1, when mounting the bracket, care should be taken to position the bracket 31 such that the operating cylinder 32 operates in a horizontal plane.

Figure 3B:
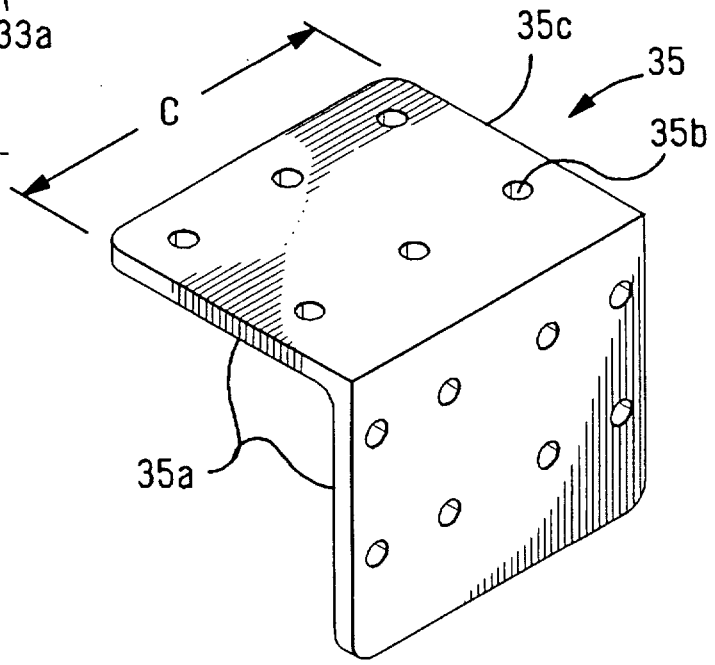
FIG. 3B shows an isometric view of the door frame mounting bracket according to the instant invention.

Having reference now to FIG. 3B, the door frame mounting bracket 35 will now be further described. The frame bracket 35 is made of a metal material in the preferred embodiment, but can be made of other materials as well. The frame bracket 35 includes flanges 35*a* having mounting holes 35*b* for receiving wood screws or bolts. The mounting holes 35*b* are advantageously spaced from edge 35*c* for the purpose of ease of installation, i.e. so that a preferred distance A (as shown in FIG. 2A) which is defined by the distance between the hinge 20 or 20' and the hole 33*a* or clevis pin, can be achieved for ensuring that the magnitude of force F1 will be sufficient to open the door (against the closing force F3 of door closer 34); while at the same time preventing the force F2 from shearing off the clevis bracket 31. Thus, for a standard door, the frame bracket 35 can be mounted against the door surface, as shown in FIGS. 2A–2B, and thereby provide the preferred position for clevis bracket 33. Moreover, the holes 35*b* are arranged on the flange 35*a* for either a left or right hand orientation relative to door 17.

Figure 4:
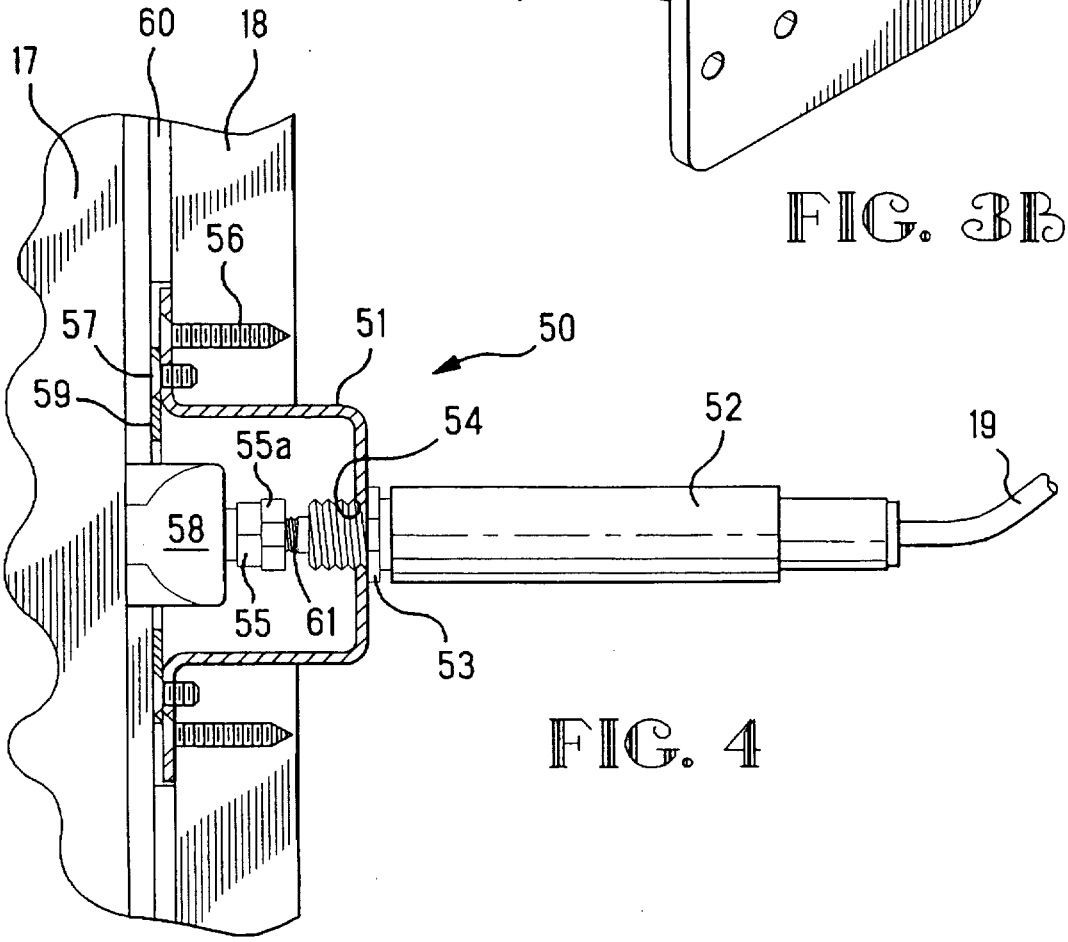
FIG. 4 shows the striker release assembly according to the present invention.

Referring now to FIG. 4, the striker release assembly will be described. The striker box 51 is mounted in a hole of the door frame 18, with a striker plate 59 mounted to the face of the striker box using machine screws 57. Wood screws 56 fasten the striker box 51 to the door frame 18 adjacent wood molding 60. Air cylinder 52 is screw threaded into hole 54 and is retained in place by nut 53. Air line 19 is supplied with pressurized air from 3-way valve 12 as shown in FIG. 1. Plunger or striker release 61 is thereby ready to extend to the left as shown in FIG. 4 to depress a spring biased door latch 58 at the start of the opening cycle, further described hereinbelow. The striker release or plunger 61 is spring biased to the right (by a spring inside air cylinder 52, not shown in the drawing) for an unpressurized location as is generally shown in FIG. 4. Cap nut 55 is threadably adjustable and is axially locked by a lock nut 55*a*.

Referring again to FIG. 1, the opening and closing cycles of the door operating system according to the instant invention will be described. In a preferred embodiment, an air compressor 11 supplies fluid pressure to 3-way solenoid valve 12. The compressor 11 has a receiver tank with a pressure switch (not shown in the drawing) to maintain compressed air in the receiver tank. Tubing 19 supplies air between the compressor 11 and 3-way valve 12. The valve 12 is electrically interlocked with the receiver 13 for open/closed control of the valve 12. The receiver 13 receives signals from the remote transmitter 14 which is used by an operator to open and close the door 17 by depressing an appropriate button on the transmitter 14. When the "open" button is pushed on the transmitter 14, the valve 12 is activated to allow pressurized air to flow through to a "tee" fitting which in turn permits air to flow to the pressure regulator 15 and striker release assembly 50. In the preferred embodiment, the pressure regulator 15 is adjusted so that the air pressure activates the striker release assembly 50 prior to activation of the cylinder 32, by virtue of providing a higher pressure to act on the striker release cylinder 52, thereby preventing a premature opening of the door 17 and consequential jamming of the door latch 58 in the door. Additionally, the pressure regulator 15 controls the speed and power acting to open the door. When the striker release assembly 50 is thus activated by the pressurized air, the plunger 61 and cap nut 55 are advanced and depress the door latch 58, thereby pushing the door latch 58 to a retracted position. The striker release assembly 50 as shown in FIG. 4 does not interfere with the normal operation of the door latch 58. Thus, the door 17 is now free to open as air cylinder 32 begins to exert an opening force F1 on the door 17 (see FIG. 2A). At this point in time, door closer 34 will start to exert an opposing, constant force F3 on the door. Air pressure continues to push cylinder 32, and door 17 opens until the cylinder 32 is in a fully extended position, which position is a factor in determining the location for bracket 35 so that door 17 can be opened 90 degrees. Closing of door 17 is effected when the operator pushes an appropriate button on the transmitter 14, which in turn activates 3-way valve 12 to a position whereby the air pressure in the door opening system side of the 3-way valve 12 is discharged to the atmosphere, while the air supply to the 3-way valve from the compressor is closed off. As the air pressure in the system decreases, the door 17 closes under the closing force F3 from door closure 34, the plunger or striker release 61 is moved to its retracted position by the spring in air cylinder 52, the door latch 58 is then pushed into door 17 by striker plate 59 and the door latch 58 is once again seated in the striker box 51 adjacent to striker release 61.

In another embodiment of the invention, bracket 33 can be rotated 180 degrees and used in combination with an offset hinge 20' as shown in FIG. 2B. This arrangement has the advantage of providing an extra width clearance of an amount approximately equal to the thickness of door 17. Such an extra clearance is desirable where, for example, a cart or wheelchair will pass through the door area. As noted above, the distances A and B will be the same where the offset hinge is be used.

Thus, while the preferred embodiments of the present invention have been described above with reference to the drawing figures, it is to be understood by persons of ordinary skill in the art that the invention is not strictly limited to such embodiments, but may be otherwise variously embodied and practiced within the scope of the following claims.

Accordingly, what is claimed is:

1. A door operating system for attachment to a hinged door and a door frame, the door operating system is operative to push a spring-biased door latch mounted in the door during an opening cycle of said door operating system, said door operating system comprising:

a fluid supply system providing pressurized fluid to the door operating system, said fluid supply system including a valve for selectively supplying said pressurized fluid;

an opening cylinder for opening said door, the opening cylinder including brackets mounting said opening cylinder to a first side of said door and door frame, said cylinder further including a port which is supplied with said pressurized fluid for opening said door;

and a striker release assembly mounted in said door frame for pushing said door latch to a retracted position, thereby allowing opening of the door, wherein the striker release assembly includes a striker release cylinder which is operatively connected to said pressurized fluid supply, and wherein said striker release cylinder includes a plunger shaft for pushing said door latch and otherwise reciprocating from an activated to a deactivated position with respect to said door latch.

2. The door operating system of claim 1, wherein the valve is a three-way valve which supplies said fluid to the opening cylinder and striker release assembly during said opening cycle, and discharging said pressurized fluid to atmosphere during a closing cycle of the door.

3. The door operating system of claim 1, wherein the fluid supply system includes a pressure regulator means for activating the striker release assembly by virtue of a higher pressure before the opening cylinder opens the door, thereby preventing a jamming of the door latch in the striker release assembly.

4. The door operating system of claim 1, wherein a pusher assist air cylinder is mounted to said door frame, and wherein said pusher assist cylinder provides additional opening force on said door.

5. The door operating system of claim 1, wherein clevis brackets mount said opening cylinder to said door and door frame;

and wherein at least a pair of said clevis brackets have a first end pivotably connected to said opening cylinder and a second end connected to a door frame bracket.

6. The door operating system of claim 5, wherein said door frame bracket is a generally L-shaped bracket and is sized for mounting generally against said first side of said door so that an edge of said door frame bracket is juxtaposed with an edge of said door when said door is in a closed position; and wherein a clevis pin on said clevis bracket is spaced from the hinges of the door at a distance equal to about twice a standard door thickness.

7. The door operating system of claim 6, wherein said hinges are offset-type hinges.

8. The door operating system of claim 1, wherein a housing of the striker release cylinder is threadably mounted in a threaded aperture of the striker box and is held in place by a fastening means.

9. The door operating system of claim 1, wherein the plunger shaft is threaded and includes an adjustable cap nut held in place by a fastening means, said cap nut being positioned to depress said door latch upon activation of said striker release cylinder.

10. The door operating system of claim 1, wherein the striker release assembly further includes a striker plate fastened to a striker box by a fastening means, and said striker box is mounted to said door frame by a fastening means separate from said striker plate fastening means.

11. The door operating system of claim 10, wherein the striker box is formed of bent, stamped sheet metal.

12. A door operating system for attachment to a hinged door and a door frame, the door operating system is activated by a pressurized fluid supply conducted via tubing for depressing a door latch and opening the door, said door operating system comprises:

an opening cylinder for opening the door, the opening cylinder includes brackets attached thereto for mounting said opening cylinder, said opening cylinder further includes a port which is supplied with the pressurized fluid;

a striker release assembly comprising a striker box mounted in the door frame, the striker release assembly further comprises a striker release cylinder which is operatively connected to the pressurized fluid supply, said striker release cylinder includes a plunger shaft for pushing the door latch, and said plunger shaft reciprocates from an activated to a deactivated position with respect to the door latch in response to activation and deactivation of said pressurized fluid supply.

13. The door operating system of claim 12, wherein the plunger shaft comprises an adjustable member held in place by a fastening member, said adjustable member is operative to be adjusted towards or away from said door latch to thereby depress said door latch upon activation of said striker release cylinder by the pressurized fluid supply.

14. A door operating system for attachment to a hinged door and a door frame, the door operating system is activated by a pressurized fluid supply conducted via tubing for depressing a door latch and opening the door, said door operating system comprises:

an opening cylinder for opening the door, the opening cylinder includes brackets attached thereto for mounting said opening cylinder, said opening cylinder further includes a port which is supplied with the pressurized fluid; and a striker release assembly comprising a striker box mounted in the door frame, the striker release assembly further comprises a striker release cylinder mounted through a first wall of said striker box and said striker release cylinder is operatively connected to the pressurized fluid supply, said striker release cylinder is connected to a plunger shaft for pushing the door latch to a retracted position, and said plunger shaft reciprocates along a first line of action from an activated to a deactivated position with respect to the door latch in response to activation and deactivation of said pressurized fluid supply.

15. The door operating system of claim 14, wherein said striker box includes a recessed area with sidewalls connected to said first wall thereby defining a cavity in which said plunger shaft is operative to reciprocate.

16. The door operating system of claim 14, wherein said opening cylinder includes a metering valve so that pressurized fluid escapes therefrom during opening of the door whereby the opening speed of the door is controlled by said metering valve.

17. The door operating system of claim 14, wherein said tubing is located within a wall located adjacent to said door frame.

18. The door operating system of claim 14, wherein said first line of action of said plunger shaft is generally aligned with a second line of action defined by the motion of said door latch as said plunger shaft forces said door latch to a retracted position.

19. The door operating system of claim 14, wherein said striker box includes at least one flange, said flange is fastened to said door frame with at least one fastener member which is generally aligned with said plunger shaft.

* * * * *